US005163465A

United States Patent [19]

King, Sr.

[11] Patent Number: 5,163,465

[45] Date of Patent: Nov. 17, 1992

[54] VACUUM BREAKER VENTING VALVE

[76] Inventor: Lloyd H. King, Sr., 2909 S. Ocean Blvd., Apt. 6D, Highland Beach, Fla. 33487

[21] Appl. No.: 763,418

[22] Filed: Sep. 20, 1991

[51] Int. Cl.[5] ..... F16K 24/00

[52] U.S. Cl. ..... 137/218; 137/107

[58] Field of Search ..... 137/102, 107, 218

[56] References Cited

U.S. PATENT DOCUMENTS

| | | | |
|---|---|---|---|
| 2,610,859 | 9/1952 | Wilcox . | |
| 2,939,474 | 6/1960 | Simone . | |
| 2,953,153 | 9/1960 | Gaul . | |
| 3,083,723 | 4/1963 | Duchin . | |
| 3,747,626 | 7/1973 | Valentino . | |
| 3,863,665 | 2/1975 | Hechler . | |
| 3,905,382 | 9/1975 | Waterston . | |
| 4,008,732 | 2/1977 | Fichter . | |
| 4,013,088 | 3/1977 | Gocke et al. . | |
| 4,332,274 | 6/1982 | Frisquet . | |
| 4,518,006 | 5/1985 | Hoffmann | 137/218 |
| 4,646,775 | 3/1987 | Traylor . | |
| 4,712,575 | 12/1987 | Lair et al. . | |

FOREIGN PATENT DOCUMENTS

| | | | |
|---|---|---|---|
| 2849825 | 5/1980 | Fed. Rep. of Germany | 137/218 |
| 36161267 | 5/1986 | Fed. Rep. of Germany . | |

*Primary Examiner*—Robert G. Nilson

*Attorney, Agent, or Firm*—Jacobson & Johnson

[57] ABSTRACT

An improved vacuum breaker valve that uses a sliding shuttle that is held in a first closed position by a compression spring and in a fluid transmitting position by the fluid pressure from the fluid supply with a fluid diverter that directs fluid into a chamber and through a fluid resistor so that the fluid pressure in the chamber can generate forces to slide the shuttle along a fluid diverter until the fluid can flow through the valve with the valve including a resilient spring to force the sliding shuttle to a open vent condition where the valve provides both a physical barrier to backflow as well as a vent to quickly and effectively vent any fluid in the downstream pipes into the atmosphere to protect the fluid supply.

4 Claims, 1 Drawing Sheet

VACUUM BREAKER VENTING VALVE

FIELD OF THE INVENTION

This invention relates generally to vacuum breaker valves and, more specifically, to valves that automatically break the vacuum in a water line connected to a water source to prevent backflow of water into the water source when the water source pressure unexpectedly drops. Such devices are required to protect the drinking water supplies against contamination in the event of a sudden and unexpected loss of water pressure in the drinking water supply when the drinking water supply is connected to possible sources of contamination such as garden hose fertilizer sprinkling systems or the like.

BACKGROUND OF THE INVENTION

One of the problems with flow through water valves that are connected to pressurized water sources is that upstream pressure supply conditions can occur that may force water to flow backwards into the water supply. For example if the water supply pressure suddenly drops the water in the pipes may flow backward into the water source. In order to prevent the backflow of water it is necessary to "break the vacuum" or permit air to enter the pipes so the water in the downstream lines can drain out of the system without being forced backward through the water valve and into the water supply. Typically, such prior art devices have relied on a check valve in the down stream water lines to close off and prevent water from flowing backwards into the water source. The present invention provides an improvement over such inventions by providing a valve that does not include a check valve to stop flow but includes a venting region to quickly decrease the pressure in the line to allow the water to be diverted and quickly vented into the atmosphere in response to the lowering of the water pressure in the supply system. The valve is responsive to the lowering of the fluid pressure in the inlet so that reverse flow conditions do not have to occur before the valve begins to begin the process of diverting the fluid through the vents.

DESCRIPTION OF THE PRIOR ART

The Wilcox U.S. Pat. No. 2,610,859 shows a quick exhausting ball type check valve that upon loss of upstream pressure quickly moves to a position to vent return fluid to the atmosphere.

The Simone et al. U.S. Pat. No. 2,939,474 shows a portable diverter valve with a conical shaped anti-siphon check valve.

The Duchin U.S. Pat. No. 3,083,723 shows a vacuum breaker valve that uses a sliding piston like check valve to prevent backflow.

The Valentino U.S. Pat. No. 3,747,626 shows a check and relief valve that permits flow of fluid in one direction but not in the other through use of a piston like actuator.

The Volmer U.S. Pat. No. 4,013,088 shows a valve that uses two sliding valves to permit one to make a check valve of relatively small diameter.

The Hoffman U.S. Pat. No. 4,518,006 shows a backflow prevention valve that has a separate check valve to prevent backflow into his supply source.

The Balz German patent DE 36 16267 A1 shows a device that prevents backflow that includes a check valve which is described as a closure member that is pressed against a valve seat by means of a compression spring. Balz does not provide means to vent the fluid from the downstream side of the valve should his check valve be closed. Balz also provides radial seals between his sliding members to block flow past his internal members.

The Hechler U.S. Pat. No. 3,863,665 shows an anit-siphon valve that permits one to mix materials into the water without having material flow back into the source.

The Gaul U.S. Pat. No. 2,953,153 shows a spring controlled safety check valve.

The Waterston U.S. Pat. No. 3,905,382 shows a back flow preventer that is responsive to pressures acting on opposing surfaces of a piston.

The Fichter U.S. Pat. No. 4,008,732 shows a diverter valve with a movable piston.

The Frisquet U.S. Pat. No. 4,332,274 shows disconnector for a drinking water fountain to prevent water from flowing backward during a drop in water line pressure.

The Traylor U.S. Pat. No. 4,646,775 shows a vacuum breaker valve with a slidable seal for use in appliances.

BRIEF SUMMARY OF THE INVENTION

Briefly, the present invention comprises an improved vacuum breaker valve that uses a sliding shuttle that is held in a first position by a compression spring and in a fluid transmitting position by the fluid pressure from the fluid supply. A fluid diverter directs fluid into a chamber so that the fluid pressure can generate forces to slide the shuttle along a fluid diverter until the fluid can flow through the valve. An annular clearance between the shuttle and fluid diverter flow allows the shuttle to move back and forth in response to the internal pressure in my valve. The valve includes a resilient spring to force the sliding shuttle to a second condition where the valve provides both a physical barrier to backflow as well as a vent to quickly and effectively vent any fluid in the downstream pipes into the atmosphere. A fluid resistance in the sliding shuttle permits the valve to rapidly close and prevent backflow through the shuttle while simultaneously opening the vents to quickly vent fluid in the downstream pipes and protect the fluid supply.

DESCRIPTION OF THE PREFERRED EMBODIMENT

Figure 1:
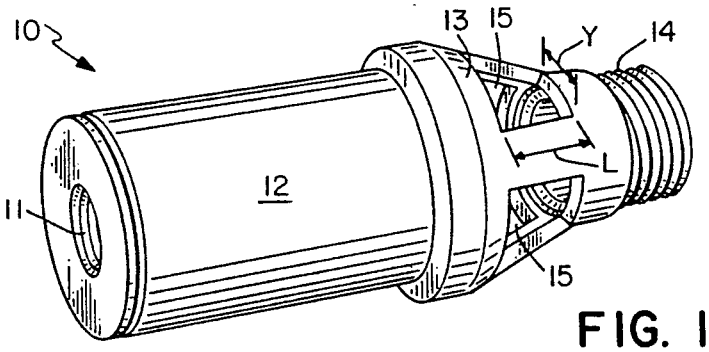
FIG. 1 is a pictoral view of my vacuum breaker valve.

Referring to FIG. 1 reference numeral 10 generally identifies my vacuum breaker valve. Valve 10 includes a cylindrical housing 12 with a threaded inlet opening 11 on one end and a fluid vent housing 13 on the other end. Fluid vent housing 13 includes a male threaded fluid outlet 14 and circumferentially spaced fluid vents 15 that permit backflow fluid to drain from my vacuum breaker valve when the downstream pressure exceeds the supply pressure. Typically, back flow vents 15 have an open venting area for fluid to discharge that is approximately 20 times the cross sectional flow area through the interior of my valve. The dimensions of the vent areas 15 are designated by L and Y. The advantage of my large vent discharge area is that I do not create any resistance to flow through vent regions 15. That is since the vent regions 15 have substantially larger areas than internal fluid passage there is very little resistance to fluid venting though vent regions 15. For example, if there is any decrease in the supply pressure the lowering of fluid supply pressure immediately cause my valve to open and vent the fluid to the atmosphere through vent area 15 before a condition of actual valve flow reversal occurs. Thus my invention prevents the fluid from flowing backwards without the need for a ball check valve or the like to seal off the fluid supply passage.

Figure 2:
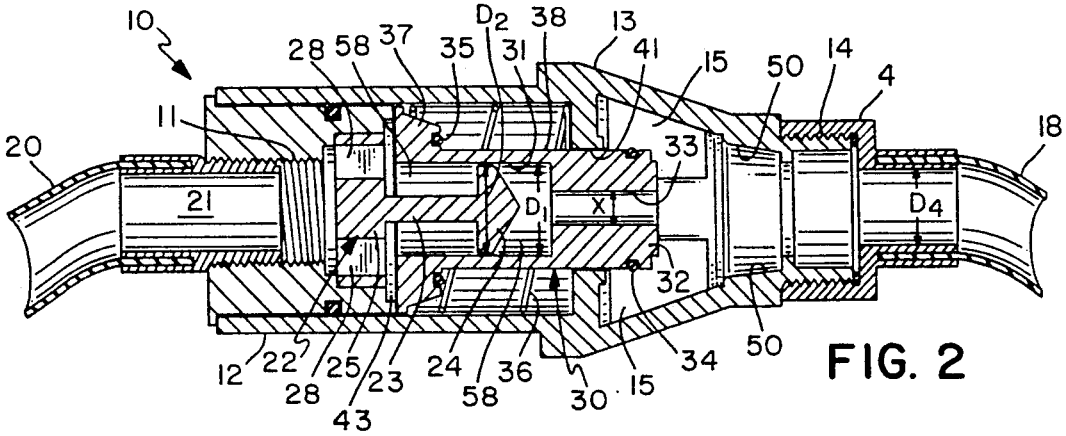
FIG. 2 is a sectional view of my vacuum breaker valve when no fluid is present in the valve.

Referring to FIG. 2 the interior of my vacuum breaker valve is detailed in a cross sectional view to reveal a fluid pressure controlled shuttle 30 that slides longitudinally back and forth in housing 12 to either direct the fluid into outlet 14 or into vents 15. Valve 10 includes an inlet member 20 that directs the fluid into a fluid chamber 21 in inlet member 20. Located downstream of chamber 21 is a fixedly mounted fluid diverter 22 that has a base 25 with openings 28 to permit fluid to flow through base 25. Extending from base 25 is a stem 23 with a circular, wedge or conical shaped flowhead 24 having an outside diameter designated by $D_2$. Flowhead 24 has an outside diameter $D_2$ that is slightly less than the inside diameter $D_1$ of fluid passage 31 in shuttle 30 to permit shuttle 30 to freely slide back and forth along flowhead 24 without being restricted by frictional forces between flowhead 24 and shuttle 30. That is, flowhead 24 and shuttle 30 are located in a non sealing relationship to each other so fluid can at all times flow between flowhead 24 and fluid passage 31.

Fluid passage 31 has a diameter designated by $D_1$. Fluid diverter 22 is fixedly mounted in valve 10 and functions to direct and divert the incoming fluid into the proper fluid chambers in conjunction with shuttle 30. For example, when flowhead 24 is located in fluid passage 31 in shuttle 30, as shown in FIG. 2, the coaction of flowhead 24 and shuttle 30 act as a physical barrier or fluid resistance to partially prevent fluid from flowing backward from chamber 58 into the source of pressurized fluid connected to inlet 20. That is flowhead 24 is not a check valve since it does not seal off the fluid from flowing backwards. However, flowhead 24 does sufficiently restrict the backward flow of fluid so as to significantly increase the fluid resistance to backward flow of fluid through valve 10. In addition flowhead 24 provides for a forward resistance to fluid flowing through valve 10 when the shuttle is in the position shown in FIG. 2.

Valve 10 includes a second fluid resistance formed by passage 33. The resistance to backward flow of fluid by flowhead 24 and shuttle 30 is greater than the resistance of back flow by fluid resistance formed by fluid opening 33. Typically, the dimension $D_2$ may be about 0.020 inches smaller than dimension $D_1$.

Figure 4:
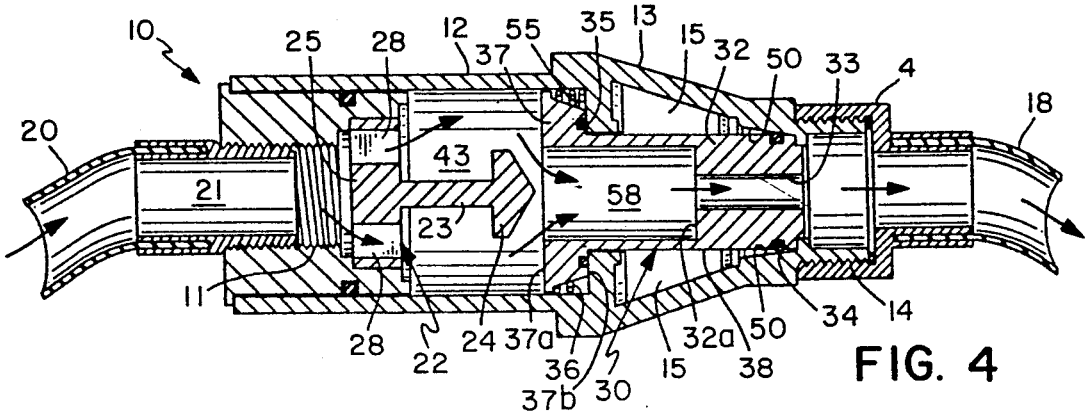
FIG. 4 shows a sectional view of my vacuum breaker valve with fluid being directed through my vacuum breaker valve.

Shuttle 30 although located in a slideable relationship in housing 12 is normally biased toward the position shown in FIG. 2 by a compression spring 36. Shuttle 30 moves between an open vent position illustrated in FIG. 2 and a closed position illustrated in FIG. 4. In operation of valve 10 the incoming fluid in valve 10 generate pressure forces that control the rightward displacement of shuttle 30 while spring 36 provides a continual return force ready to return the shuttle to its original position when the pressure forces in the fluid supply decreases to a level insufficient to sustain the shuttle in the closed position as shown in FIG. 4. That is in order for fluid to flow through my valve, shuttle 30 must have sufficient back pressure generated in chamber 43 so as to produce a force to direct shuttle to the closed vent position or through flow position as shown in FIG. 4. The back pressure in chamber 43 is created by the partial obstruction of passage 31 by flowhead 24 which offers a forward resistance to fluid flowing through the shuttle since the flowhead 24 and passage form a resistance to fluid flowing therethrough when the flowhead and the shuttle are in the position shown in FIG. 1. However, when shuttle 30 is displaced to the right as shown in FIG. 4 the resistance to fluid flow because of interaction of the flowhead and the passage 31 is virtually eliminated.

Shuttle 30 includes an annular base 37 that includes a resilient sealing ring 35 located in face **37*b* of base 37. Extending perpendicular from base 37 is a cylindrical tube 32 whose exterior surface 38 sliding moves within a circular opening 41 in housing 13. Located concentrically within tube 32 is a fluid passage 33 that has a diameter "x" that is smaller than the inlet diameter or other fluid passages upstream of the fluid passage 33. That is the opening 33 is the smallest cross sectional area in valve 10 when the valve 10 is in the closed position as shown in FIG. 4. Opening 33 is sufficiently small so it acts as a fixed fluid resistor to provide a continuous restriction or resistance to fluid flowing completely through valve 10. The use of the opening 33 as a fluid resistance creates a region of high pressure fluid in chamber 58 located behind opening or passage 33 thus resulting in pressure forces continually acting on the end of shuttle 30 to control the movement of the shuttle. The total cross sectional area of passage 33 through shuttle 30 is sufficiently small in comparison to the vent areas 15 so that there is provided a path of high resistance to fluid flowing back into the source 21 but very little resistance to fluid flowing into vent region 15. Typically, passage 31** has an area one twentieth of the area of the vent regions.

A compression spring 36 normally holds shuttle 30 in the far left position as shown in FIG. 2, however, the forces generated by the fluid pressure in chambers 43 and 58 control the movement of shuttle to the right or toward the position where fluid can be directed through valve 10.

Vent housing 13 includes peripherally spaced vents 15 to permit fluid to escape from the vent housing. Located on the interior end of vent housing 13 is a conical shaped sealing region 50 that forms a fluid tight sealing engagement with a sealing ring 34 located on tube 38. That is when shuttle 30 is displaced to the right the end of tube 38 is forced into a sealing relationship with region 50 to prevent fluid from escaping through vents 15. The use of a conical shaped sealing region guides the end of the shuttle into proper position and the sealing ring 34 seals the between shuttle 30 and region 50 to prevent loss of fluid when the valve is operating normally. In the closed position as shown in FIG. 4 seals 34 and 35 prevent leakage of fluid from my valve, however, in the open position as shown in FIG. 2 there are no seals that prevent backflow into the supply source. Instead the fluid resistance to fluid flowing through passage 33 and around fluid flowhead 24 is sufficiently greater than the the resistance to fluid flowing through the fluid vent areas 15. Consequently, fluid from passage 18 is vented to the atmosphere through vents 15 rather than being diverted backward into the source 21.

In order to understand the operation of my valve as a vacuum breaker reference should be made to FIG. 2 which shows my valve in the relaxed, open, or venting position. In the condition illustrated in FIG. 1 no fluid is present in the system and shuttle 30 is displaced to the left and held in position by spring 36.

Figure 3:
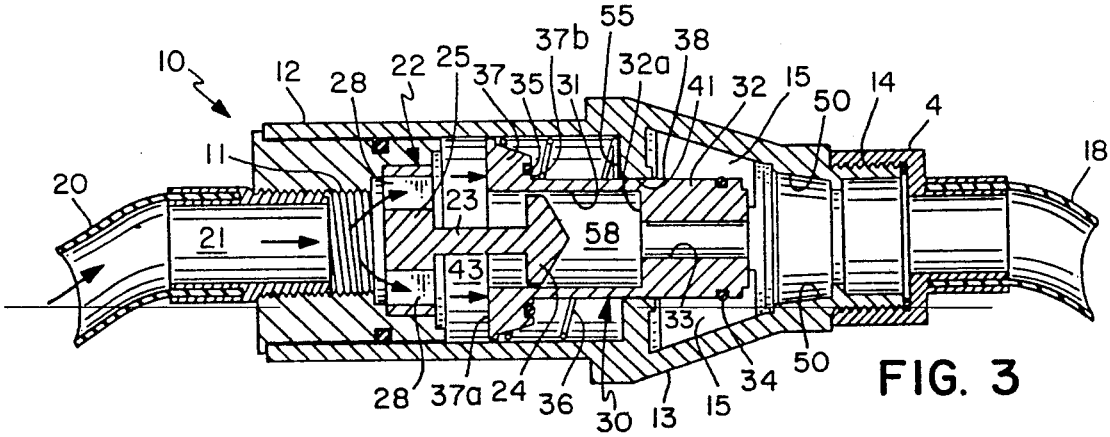
FIG. 3 shows a sectional view of my vacuum breaker valve as the valve is about to close due to the water pressure at the inlet.

FIG. 3 shows what happens as fluid under pressure is supplied to inlet chamber 21. The fluid, which typically may be water, (indicated by arrows) flows into chamber 21 and through openings 28 into annular chamber 43 thus increasing the pressure of the water in chamber 43. That is the flowhead 24 acts as a forward fluid resistor by preventing the free flow of fluid through shuttle 30 causing the water pressure in chamber 43 to increase. As the water pressure in annular chamber 43 increases because it cannot flow freely past flowhead 24 it acts on annular shuttle surface 37*a* to force shuttle 30 toward the right. Since flowhead 24 is stationary it prevents fluid from flowing into chamber 58 unless the shuttle is moved to the right. As the water pressure to inlet 20 increases it reaches a level where the water pressure of the fluid in chamber 43 becomes sufficiently great to forces shuttle 30 to slide toward the right as the force generated by the water pressure overcomes the compression force generated by spring 36. As the shuttle moves more toward the right the end of shuttle 30 clears the flowhead 24 allowing the water to more freely flow around flowhead 24 and through passage 33. Once shuttle 30 moves to the right the fluid resistance of passage 33 prevents the fluid pressure in chamber 43 dropping to a level that would cause the spring force to force the shuttle 30 to the return position. That is the shuttle is prevented from oscillating back and forth by the maintenance of back pressure in chamber 43 by resistance 33. If the supply pressure is sufficiently high the shuttle can be maintained in the displaced condition as shown in FIG. 4. In order to maintain the shuttle in the position as shown in FIG. 4 it is necessary to have a positive back pressure generated in chamber 43. The pressure in chamber 43 must have a positive value to overcome the spring forces. This means that the shuttle will begin to return to its original position even though a back flow condition has not been reached. For example, assuming that a fluid pressure of 15 psi is required in chamber 43 to keep the shuttle 30 in the position shown in FIG. 4. If the pressure in the supply source 21 decreases the pressure in chamber 43 immediately deceases causing the fluid pressure in chamber 43 to go below 15 psi. As the fluid pressure goes below 15 psi and before water even begins to flow backward through the system shuttle 30 begins to move to the open vent conditions as shown in FIG. 2 since the spring bias forces push shuttle around flowhead 24.

FIG. 4 illustrates what happens after shuttle 30 is driven toward the far right or sealing position in valve 10. In the condition illustrated in FIG. 4 the sealing ring 34 engages sealing area 50 and blocks off vent passages 15. With shuttle 30 displaced to the right the fluid enters chamber 21 and flows though openings 28 and into chamber 43. The fluid is then forced to flow around flowhead 24 into chamber 58 and through fluid resistor passage 33. The coaction of flowhead 24 and the larger chamber 43 produces a region of higher pressure which acts on the annular surface 37*a* and 32*a* to hold shuttle 30 in the position shown as long as fluid continues to flows through valve 10. In the condition shown in FIG. 4 it is apparent that the fluid flows completely through valve 10 and while doing so uses some of its energy to compress spring 36 and hold shuttle 30 in the closed position. As long as the fluid flows through valve 10 the valve continually directs the fluid from inlet 20 to outlet passage 18.

If the fluid is shut off or reduced at inlet 21 the pressure in chambers 21, 43, and 58 decreases. As the pressure decreases in chamber 43 the inherent force generated by spring 36 forces shuttle to the left until the shuttle 30 is in the position shown in FIG. 2. That is, even though fluid is still flowing from source 20, the forces generated by the fluid become insufficient to hold shuttle in the far right or closed position since the forces are less than the return forces generated by spring 36. With insufficient fluid pressure to hold shuttle 30 in the closed position the shuttle begins to return to the position illustrated in FIG. 1. As it does so the pressure in chamber 43 is partially maintained by the resistance to flow through valve 10 increasing as the coaction of flowhead 24 and passage 21 increases the resistance to fluid flow thus preventing a rapid drop of the pressure in chamber 43 as a result of the lowering of the supply pressure. That is, the closing action of the shuttle creates a greater resistance to backflow by increasing the resistance to fluid flowing through the valve. With the shuttle in the condition illustrated by FIG. 2 it is apparent that any fluid in outlet 18 will take the path of least resistance through vent passages 15 and will be discharged to the atmosphere rather then being forced or sucked back into the supply source. Note, while flowhead 24 acts as a physical barrier to prevent fluid from flowing backward into the fluid inlet it does not act as a seal to block fluid from flowing backward though valve 10. The prevention of back flow of fluid is thus prevented without a check valve and is prevented by changing of flow paths by increasing the resistance of flow in one direction and decreasing the resistance to flow of fluid in the opposite direction.

I claim:

1. A fluid vacuum breaker valve having an upstream inlet side for connection to a pressurized source of fluid and a downstream outlet side with the fluid vacuum breaker valve operable for interrupting the flow of fluid through the vacuum breaker valve when the pressure of the fluid on the downstream side of the valve exceeds the pressure on the upstream inlet side to thereby prevent backflow of fluid into the source of fluid comprising:

a housing, said housing including a fluid inlet for connection to a source of fluid under pressure;

a first fluid chamber in fluid communication with said fluid inlet, said first fluid chamber located proximate said fluid inlet;

a second fluid chamber;

a fluid outlet connected to said housing to direct fluid from said fluid inlet away from said housing;

a fluid vent connected to said housing to vent fluid away from said housing when the downstream pressure at the fluid outlet exceeds the upstream pressure at the fluid inlet, said fluid vent having a first fluid resistance to fluid flowing therethrough;

a fluid operable shuttle, said shuttle having an annular base with a sealing member located thereon to seal said shuttle against an annular sealing surface in said housing, said shuttle slidable mounted in a non sealing position in said housing, said shuttle slidable between a nonventing position and a venting position, said shuttle including a fluid passage forming a fluid resistor, said fluid passage in said shuttle having an area that is about twenty times less than the area of the fluid vent in said valve, said fluid resistor having a second fluid resistance to fluid flowing therethrough, said second fluid resistance having greater resistance to fluid flowing therethrough than the first fluid resistance so that when fluid is flowing normally through said housing with said shuttle in the nonventing position the fluid generates a higher pressure in said second fluid chamber than in said outlet to hold said shuttle in a nonventing position over said fluid vent to thereby prevent fluid discharging through said fluid vent when the pressure in the outlet remains unrestricted, said first fluid resistance to fluid flowing therethrough being substantially less than said second fluid resistance to fluid flowing through said shuttle to thereby permit fluid from said outlet to discharge through the lower first resistance of the fluid vent rather than the higher fluid resistance passage in the shuttle in response to an increase in fluid pressure in said outlet thereby preventing backflow of fluid through said housing and into said first fluid chamber by venting fluid through said lower fluid resistance path in said fluid vent rather than through said first fluid chamber in said housing;

means for providing a return force on said shuttle; and a fluid diverter located in said second fluid chamber to divert incoming fluid around said diverter before the fluid flows through said shuttle, said shuttle including a central opening that sliding moves over said flowhead on said diverter without sealing between said flowhead and said central opening, said fluid resistor and said fluid diverter coacting to produce sufficient pressure in said first fluid chamber so that when said valve is connected to a water supply the pressure generated in said first fluid chamber is sufficient to overcome the return force on said shuttle to permit the shuttle to form a non venting position with said housing to permit fluid to be directed through said valve.

2. The valve of claim 1 wherein said shuttle includes a sealing surface for engaging an annular sealing surface in said housing to prevent fluid from flowing around said shuttle.

3. The valve of claim 1 wherein said diverter includes a stem with a convex flowhead connected thereto to divert fluid around said flowhead with said flowhead having a first diameter $D_2$ and said second fluid chamber having a second diameter $D_1$ that is greater than the diameter $D_2$ to thereby permit fluid to flow past said flowhead when said flowhead is located in said second fluid chamber.

4. The valve of claim 1 wherein said means includes a compression spring that produces a force to direct said shuttle toward a venting position.

* * * * *